US007267574B2

(12) United States Patent
Wei et al.

(10) Patent No.: US 7,267,574 B2
(45) Date of Patent: Sep. 11, 2007

(54) CONNECTOR FOR FLEXIBLE PRINTED CIRCUIT

(75) Inventors: Ti-Li Wei, Tu-Cheng (TW); Guo-Jiun Shiu, Tu-Cheng (TW); Chi Zhang, Kunshan (CN); Guo-Jian Shen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/414,796

(22) Filed: May 1, 2006

(65) Prior Publication Data

US 2006/0252302 A1 Nov. 9, 2006

(30) Foreign Application Priority Data

May 6, 2005 (TW) ..... 94207286 U

(51) Int. Cl.
*H01R 12/24* (2006.01)

(52) U.S. Cl. ..... 439/495; 439/260

(58) Field of Classification Search ..... 439/495, 439/260, 267
See application file for complete search history.

(56) References Cited

U.S. PATENT DOCUMENTS 4,630,874 A * 12/1986 Renn et al. ..... 439/263
5,695,359 A * 12/1997 Fujikura et al. ..... 439/495
5,695,360 A * 12/1997 Seto et al. ..... 439/495
5,839,917 A * 11/1998 Takahashi et al. ..... 439/495
5,924,891 A * 7/1999 Benjamin et al. ..... 439/495
6,203,345 B1 * 3/2001 Roque et al. ..... 439/260
6,254,413 B1 * 7/2001 Yasui et al. ..... 439/260
6,338,648 B1 * 1/2002 Miura et al. ..... 439/495
6,352,442 B1 * 3/2002 Kudo ..... 439/260
6,471,541 B2 * 10/2002 Kunishi et al. ..... 439/495
6,514,101 B1 * 2/2003 Miura ..... 439/495
6,533,606 B2 * 3/2003 Yamane ..... 439/495
6,679,713 B2 * 1/2004 Miura ..... 439/260
6,837,740 B2 1/2005 Kunishi et al.
6,921,274 B2 * 7/2005 Yu ..... 439/260
7,063,559 B2 * 6/2006 Wang et al. ..... 439/495
2003/0157829 A1 * 8/2003 Kunishi et al. ..... 439/495
2005/0260885 A1 * 11/2005 Lu ..... 439/495

FOREIGN PATENT DOCUMENTS

JP 3278742 2/2002

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector (100) adapted to be detachably fitted with a sheet-like member includes a housing (1) defining a longitudinal direction (A) and a cavity (11) having a front opening for receiving the sheet-like member; terminals (2) arranged in the housing along the longitudinal direction and each having a contact portion (221) protruding into the cavity; pivot beams (3) loaded in the housing and separately set from the terminals; and an actuator (4) pivotally engaging with the pivot beams and rotatable between an open position and a closed position.

15 Claims, 10 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit hereafter will be generally referred to as "FPC" for simplification.

2. Description of Related Art

A conventional FPC connector generally includes an insulative housing formed with an FPC inserting portion, a plurality of terminals loaded in parallel relationship with a predetermined pitch in the insulative housing and each including at least a contact beam for electrically contacting the FPC and a pivot beam integrally extending from the contact beam, and a pivoting actuator for establishing electrical contact between the conductors of the FPC and contact beams of the terminals. Typical connectors of this type can be seen in U.S. Pat. No. 6,837,740 and Japanese Patent Laid-Open No. 11-250147.

However, as the terminal including at least two beams (the contact beam and the pivot beam) is a one-piece structure, it is required the housing to provide a substantially like cavity for correspondingly receiving the terminal. Forming of such kinds of terminal receiving cavities would diminish the structural strength of the FPC connector. On the other hand, as the contact beam extends down from the pivot beam and then is bent to be parallel to the pivot beam, there is a long way from the contact point (which is adapted to electrically contact the FPC) of the contact beam to the solder pat. Thus the transmission path of electrical signals in the terminal is long and the impedance of the terminal is large, which would largely reduce the transmission efficiency of the FPC connector.

Therefore, a new FPC connector is desired to overcome the disadvantages of the prior arts.

SUMMARY OF THE INVENTION

An object of the present invention is to provide an FPC connector which has a reliable structural strength.

Another object of the present invention is to provide an FPC connector in which the impedance of terminals is reduced.

In order to achieve above-mentioned objects, an FPC connector for connecting an FPC in accordance with a preferred embodiment of the present invention includes a housing defining a longitudinal direction and a cavity having a front opening for receiving the FPC; terminals arranged in the housing along the longitudinal direction and each having a contact portion protruding into the cavity; pivot beams loaded in the housing and separately set from the terminals; and an actuator pivotally engaging with the pivot beams and rotatable between an open position and a closed position.

Other objects, advantages and novel features of the present invention will become more apparent from the following detailed description of the present embodiment when taken in conjunction with the accompanying drawings.

DETAILED DESCRIPTION OF THE INVENTION

Figure 1:
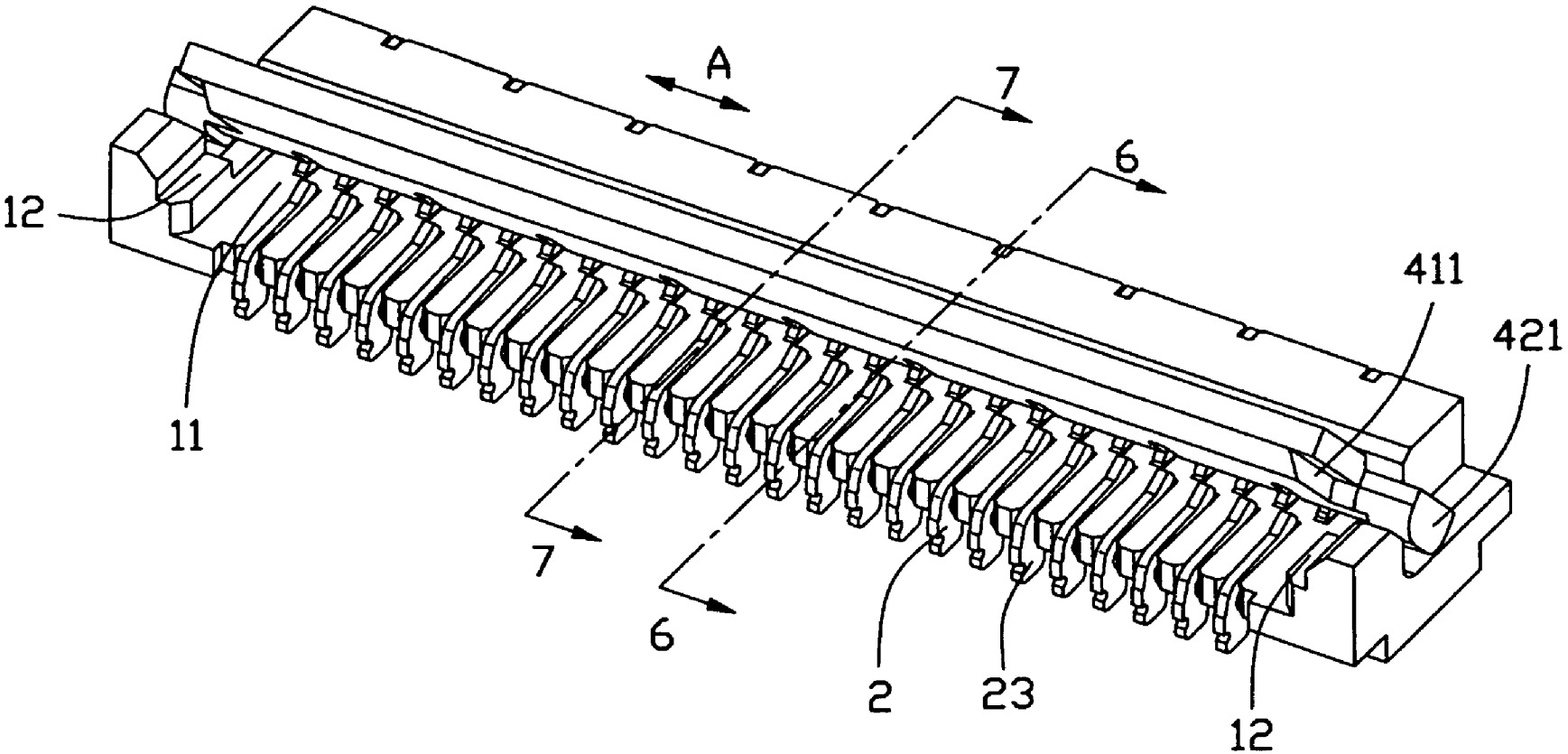
FIG. 1 is an assembled perspective view of an FPC connector in accordance with a first embodiment of the present invention.

Reference will now be made to the drawing figures to describe the preferred embodiment of the present invention in detail.

Figure 3:
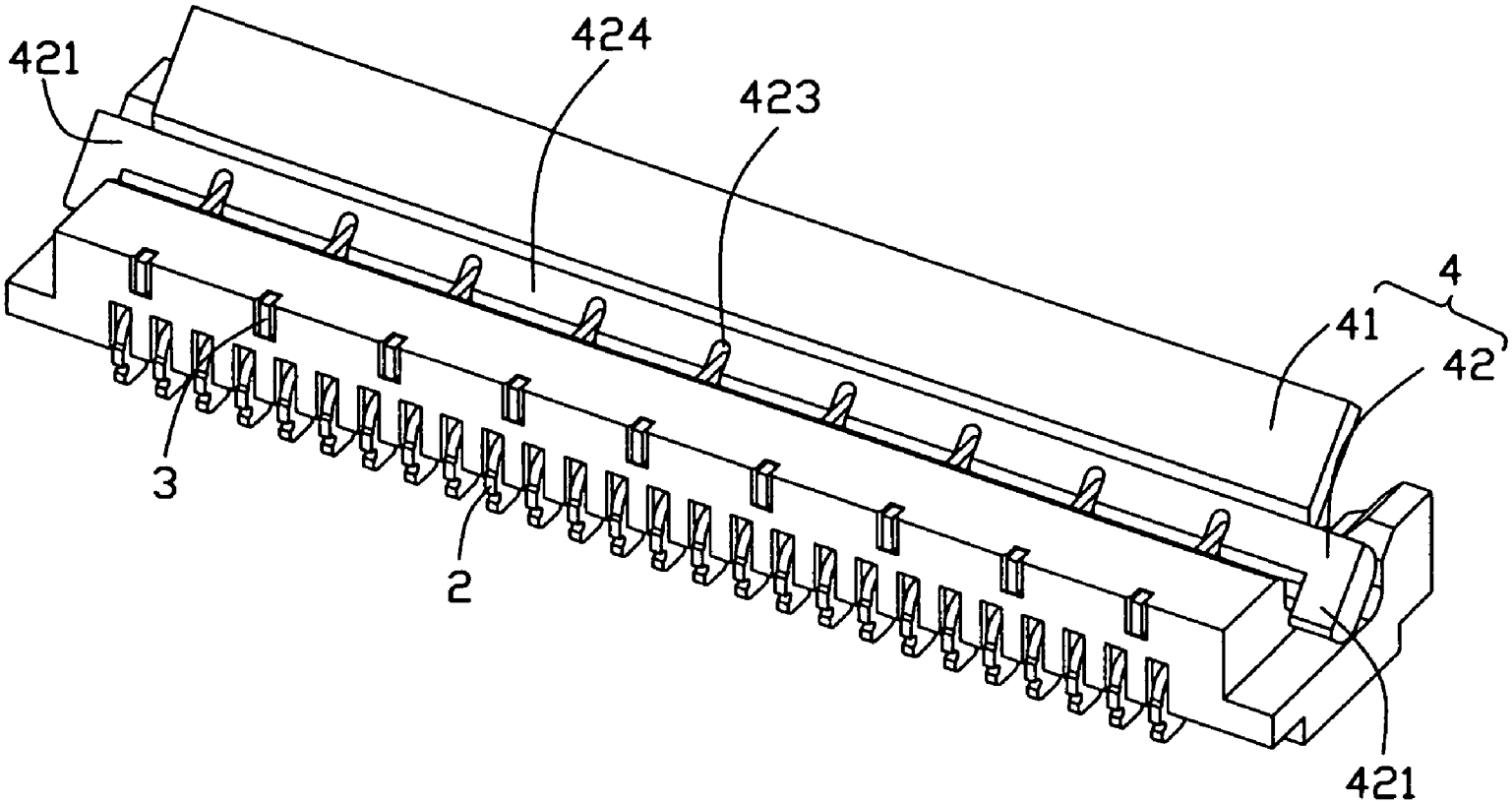
FIG. 3 is a third assembled perspective view of the FPC connector shown in FIG. 1, taken from a third aspect.

Referring to FIGS. 1 and 3, an FPC connector 100 for connecting an FPC (not shown) to a board or the like in accordance with a first embodiment of the present invention comprises an insulative housing 1, a plurality of terminals 2, pivot beams 3, and an actuator 4.

Figure 2:
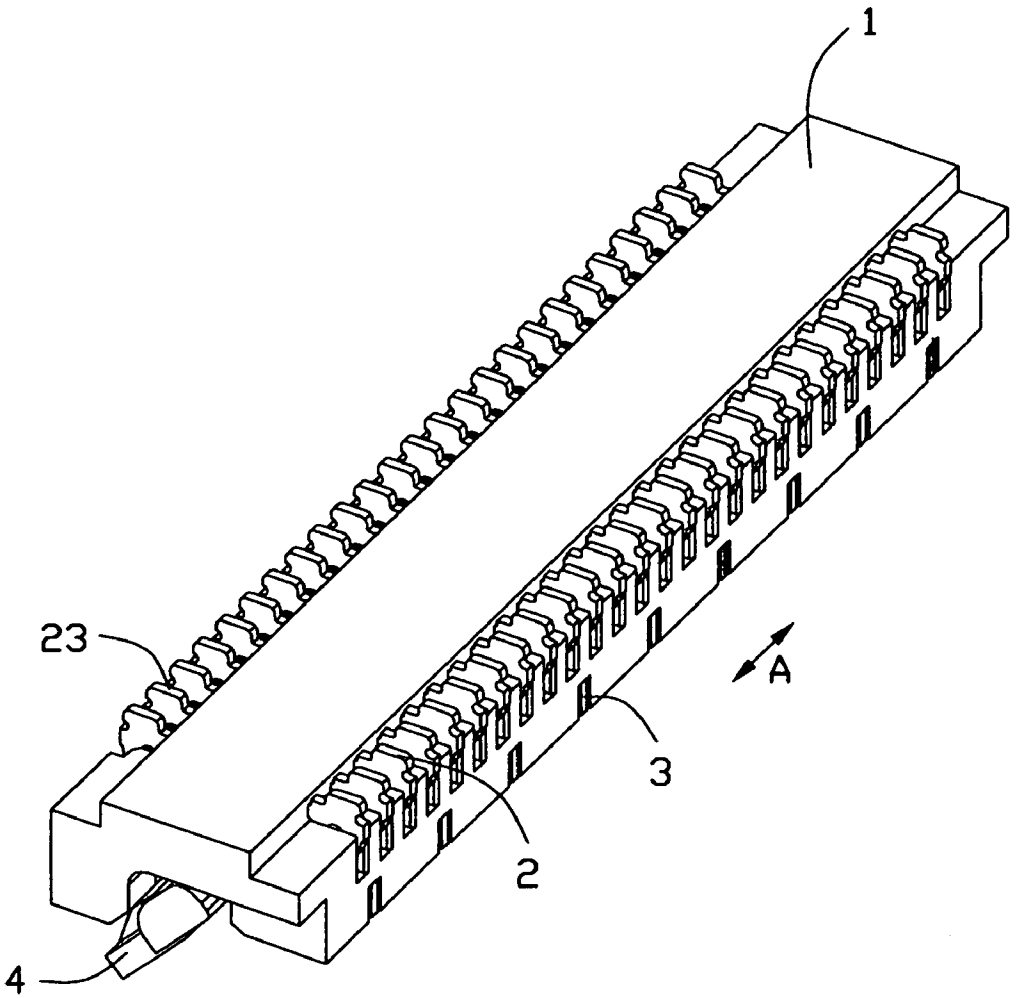
FIG. 2 is another assembled perspective view of the FPC connector shown in FIG. 1, taken from another aspect.
Figure 4:
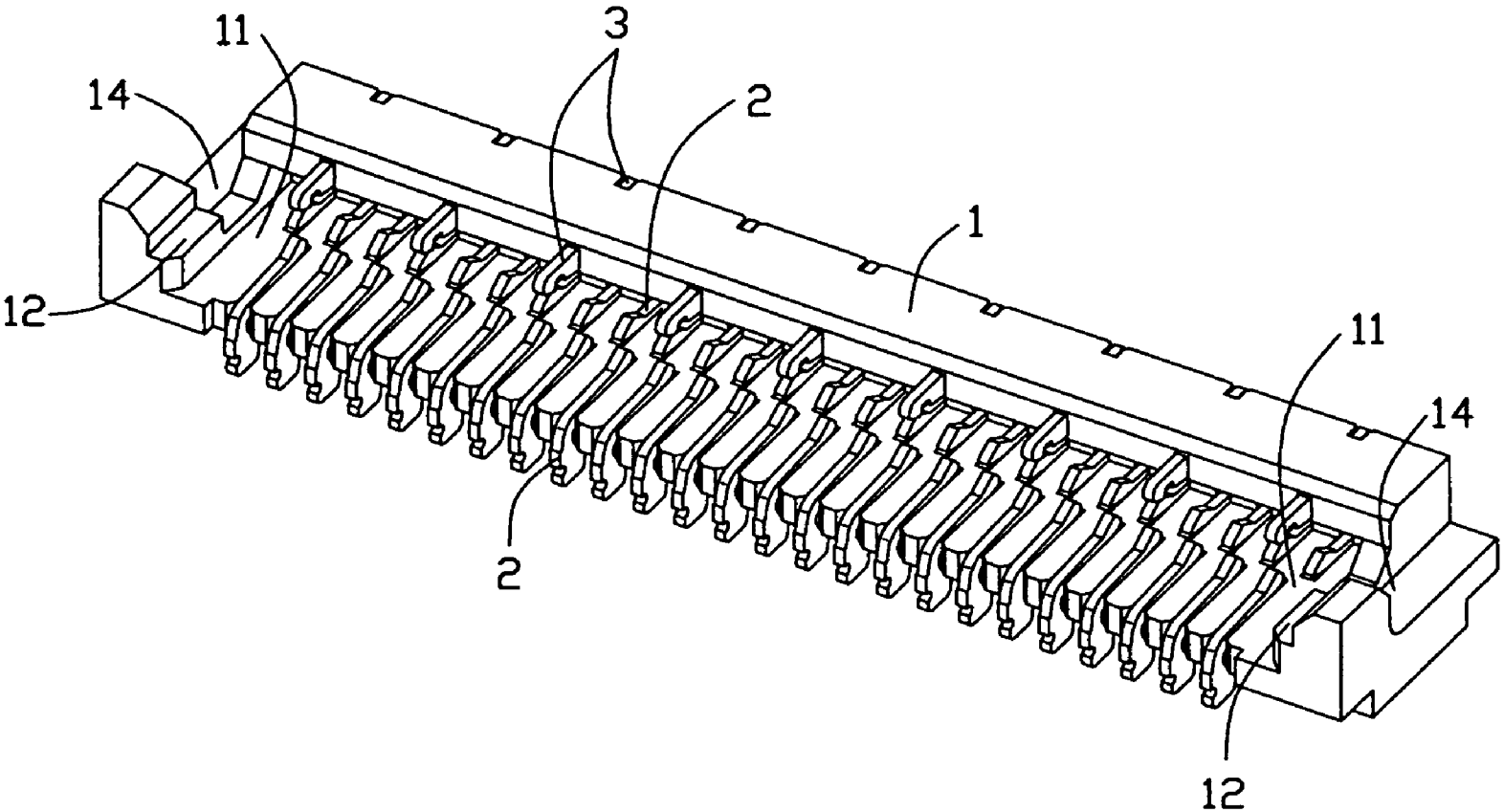
FIG. 4 is a perspective view of the FPC connector shown in FIG. 1 wherein an actuator has been removed.
Figure 5:
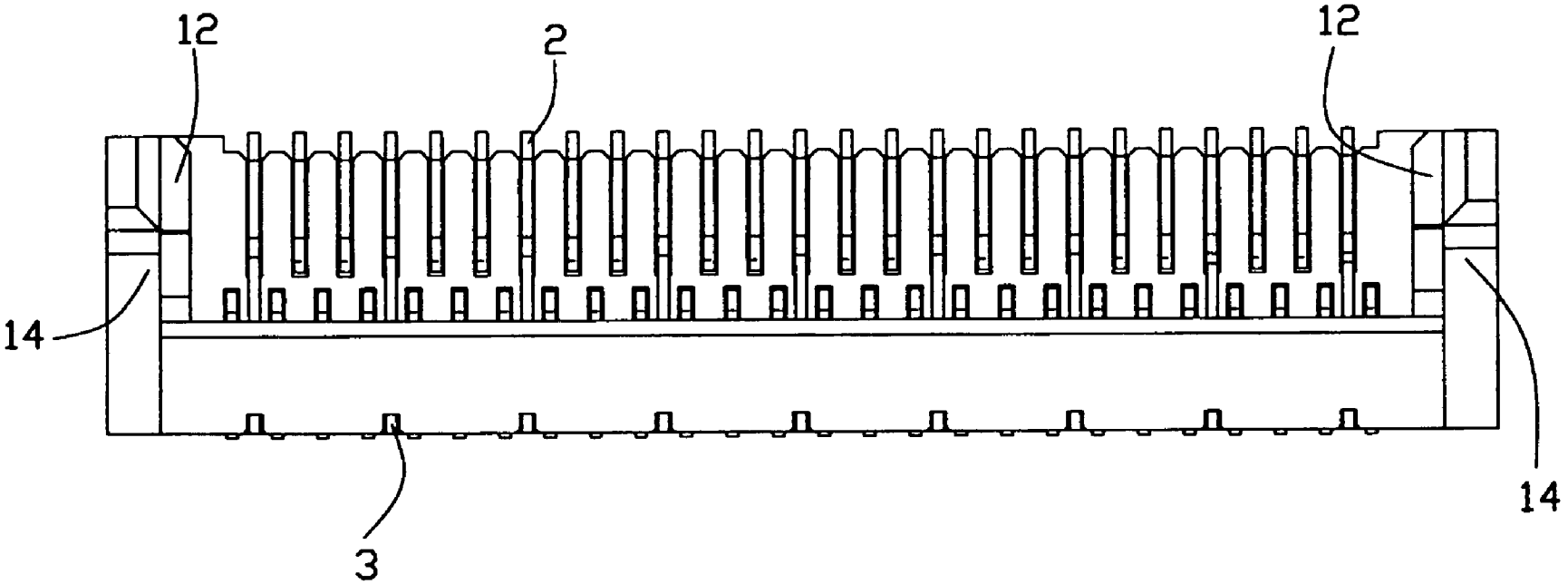
FIG. 5 is a plan view of FIG. 4.
Figure 6:
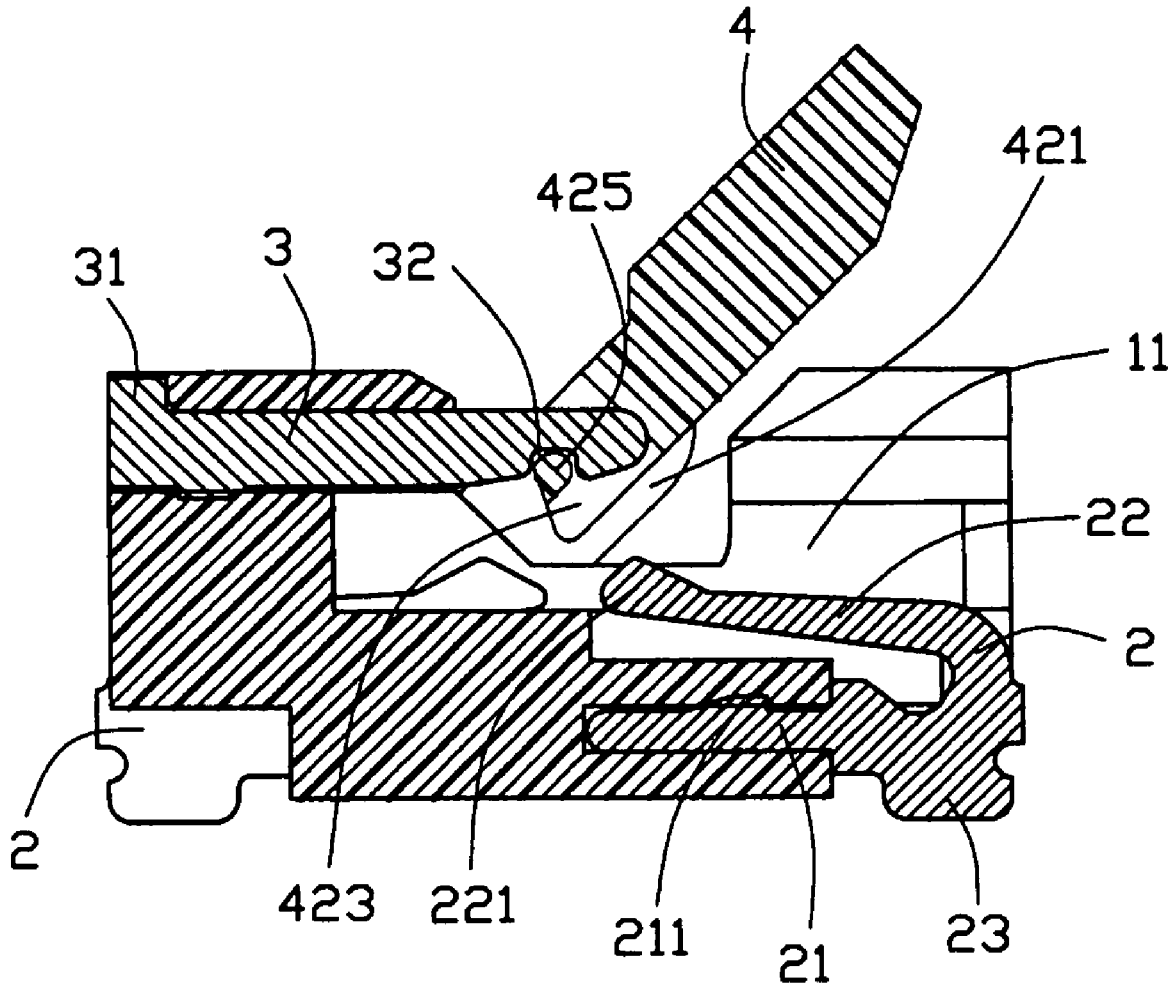
FIG. 6 is a cross-sectional view of FIG. 1 taken along line 5-5.
Figure 7:
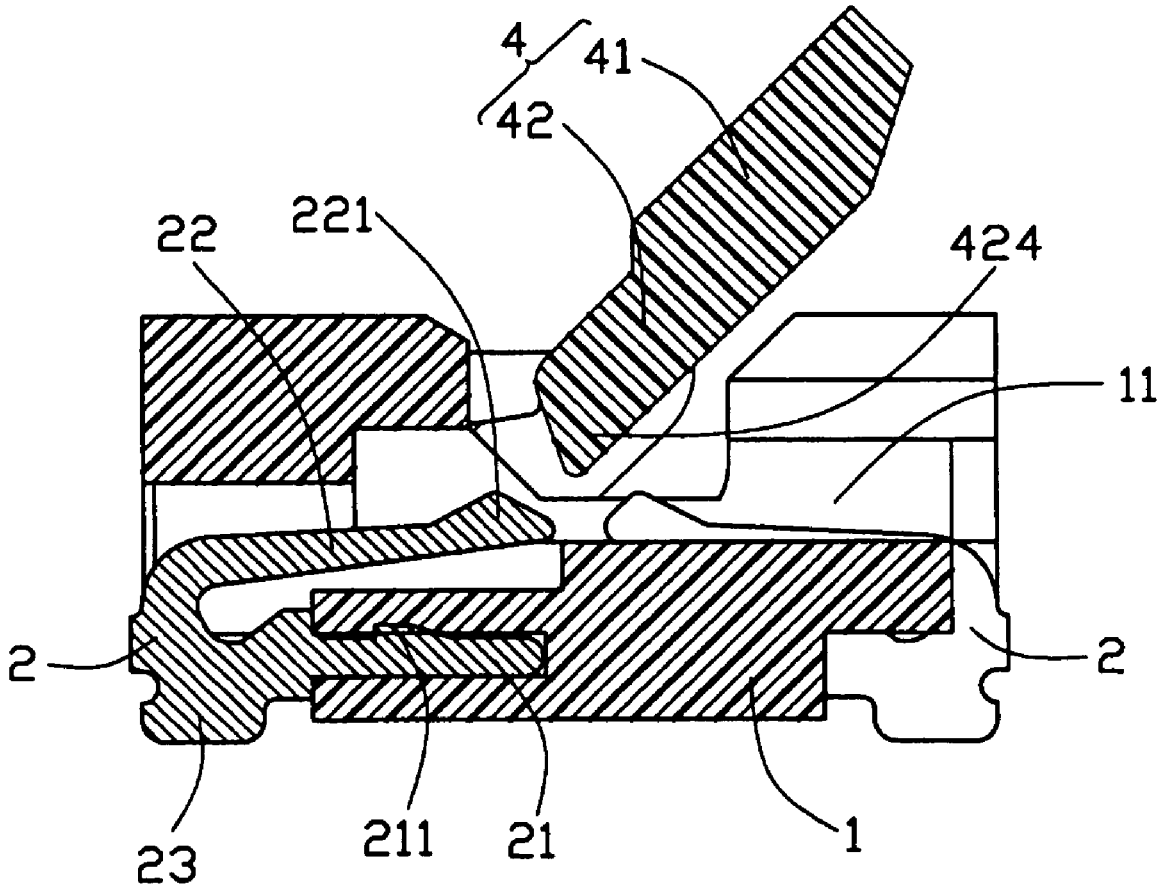
FIG. 7 is a cross-sectional view of FIG. 1 taken along line 6-6.

Referring to FIGS. 2, 4, and 5, the insulative housing 1 is of an elongated form and defines a longitudinal direction A, and is provided with an FPC receiving cavity 11 having both a top opening (not labeled) and a front opening (not labeled). The terminals 2 are arranged in two rows along the longitudinal direction A in the insulative housing 1, and the terminals 2 in each row are arranged in a side-by-side fashion, wherein the first row of terminals 2 are inserted from the rear side of the insulative housing 1 while the second row of terminals 2 are inserted from the front side of the insulative housing 1. Referring to FIGS. 4, 6 and 7, the first and second rows of terminals 2 are arranged in a head-to-head relationship and terminals 2 in the first row and terminals 2 in the second row are alternatively arranged along the longitudinal direction A. Such an arrangement fashion of the terminals 2 makes the insulative housing 1 be able to accommodate as many terminals 2 as possible while there is still a enough space between each two adjacent terminals 2 and thereby will optimize the whole structure of the FPC connector 100.

As best shown in FIGS. 6 and 7, each of the terminals 2 has a fixing arm 21 fixed in the insulative housing 1, a contact arm 22 running parallel to the fixing arm 21, and a solder foot 23 extending down from a joint of the fixing arm 21 and the contact arm 22, wherein the fixing arm 21 is formed with a retaining pawl 211 clasping the insulative housing 1 for preventing the terminal 2 from being withdrawn, and the contact arm 22 is formed with a contact portion 221 protruding to the FPC receiving cavity 11.

Referring to FIGS. 3-6, now the pivot beams 3 will be explained in detail. The pivot beams 3 are also arranged in a row at the upper side of the first row of terminals 2, and along the longitudinal direction A, each pivot beam 3 is located between some of two adjacent terminals 2 in the first row. The pivot beam 3 has a retaining tail 31 hooking at the insulative housing 1 for diverting or dispersing the force that the pivot beam 3 puts on the insulative housing 1, thereby making the pivot beam 3 firmly retained in the insulative housing 1. The retaining tail would be a right-angled hook as illustrated in FIG. 6 and would also be other forms, such as a curve hook. The pivot beam 3 further defines a pivot concave 32 at a lower edge of the tip end thereof for pivotally engaging with the actuator 4. By separating the pivot beam 3 from the terminal 2 and making it individual a one, the pivot beams 3 and the terminals 2 can be respectively assembled into the insulative housing 1, and as the row of the pivot beams 3 and the first row of terminals 2 are separate and the space therebetween is filled with plastic of the insulative housing 1, thus in certain extend enhancing the structural strength of the insulative housing 1. Otherwise, the arrangement fashion that the pivot beams 3 are respectively located between some of two adjacent terminals 2 in the first row along the longitudinal direction A, as stated above, makes the pivot beams 3 and the terminals 2 in the first row be alternatively arranged along the longitudinal direction A, thereby further enhancing the structural strength of the insulative housing 1.

Referring to FIGS. 1, 3 and 6, the actuator 4 is form into a plate form so as to open or close the top opening of the FPC receiving cavity 11, and comprises a plate portion 41 and a pivot edge 42 on one side of the plate portion 41 adjacent to the pivot beams 3. In order to engage with the pivot concave 32 provided in the pivot beam 3, a shaft portion 425 (shown in FIG. 6) is provided on the pivot edge 42 of the actuator 4 at a position corresponding to the position of pivot concave 32. The shaft portion 425 is formed by providing a groove 423 corresponding to the pivot beam 3 on the pivot edge 42 of the actuator 4. Between adjacent shaft portions 425 are pushing projecting portions 424 located between adjacent pivot beams 3. The pushing projecting portions 424 extend from the lower surface of the actuator 4, as best shown in FIG. 7. The pivot edge 42 further has a pair of support bosses 421 at longitudinal ends thereof which are respectively supported on support recesses 14 at the insulative housing 1 so as to prevent the actuator 4 from downward movement to maintain engagement between the shaft portion 425 and the pivot concave 32. As best shown in FIG. 6, all the shaft portions 425 and the support bosses 421 have a common axis for pivotal rotation. By engaging the shaft portions 425 of the actuator 4 with the pivot concaves 32 of the pivot beams 3, the actuator 4 is pivotable between an open position where the actuator 4 is raised so as to allow the FPC to be inserted into the FPC receiving cavity 11 with Zero-Insertion-Force and a closed position where the actuator 4 is oriented substantially parallel to the insulative housing 1 so as to push the FPC to electrically contact the contact portions 221.

The plate portion 41 is provided with lock cutouts 411 at longitudinal end portions thereof, and corresponding to these lock cutouts 411, the insulative housing 1 is formed with lock blocks 12 at longitudinal end portions thereof. When the actuator 4 is rotated to the closed position substantially parallel to the insulative housing 1 to close the top opening of the FPC receiving cavity 11, the lock cutouts 411 will engage with the lock blocks 12 for maintaining the actuator 4 in that closed position.

Figure 8:
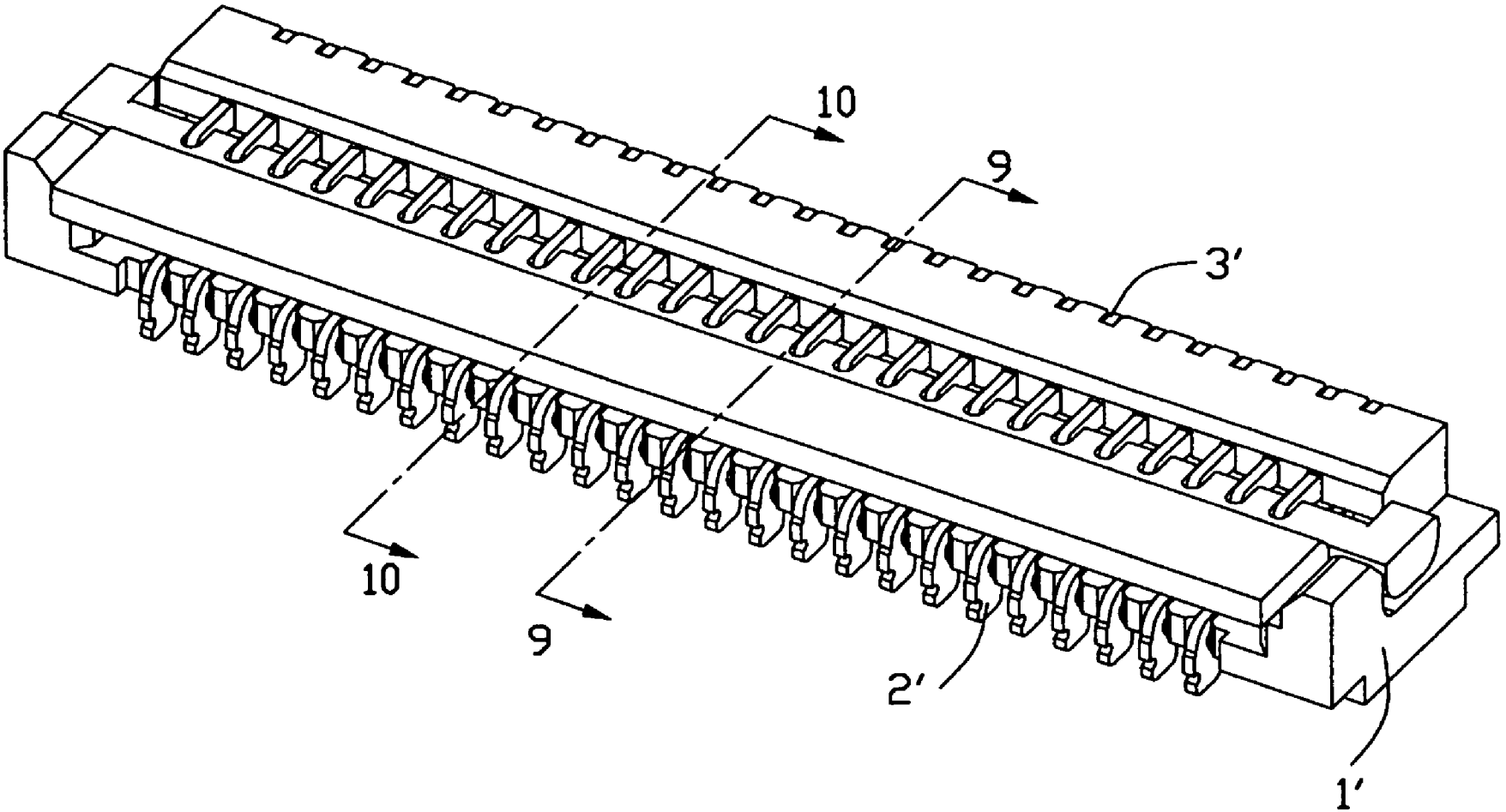
FIG. 8 is an assembled perspective view of an FPC connector in accordance with a second embodiment of the present invention.
Figure 9:
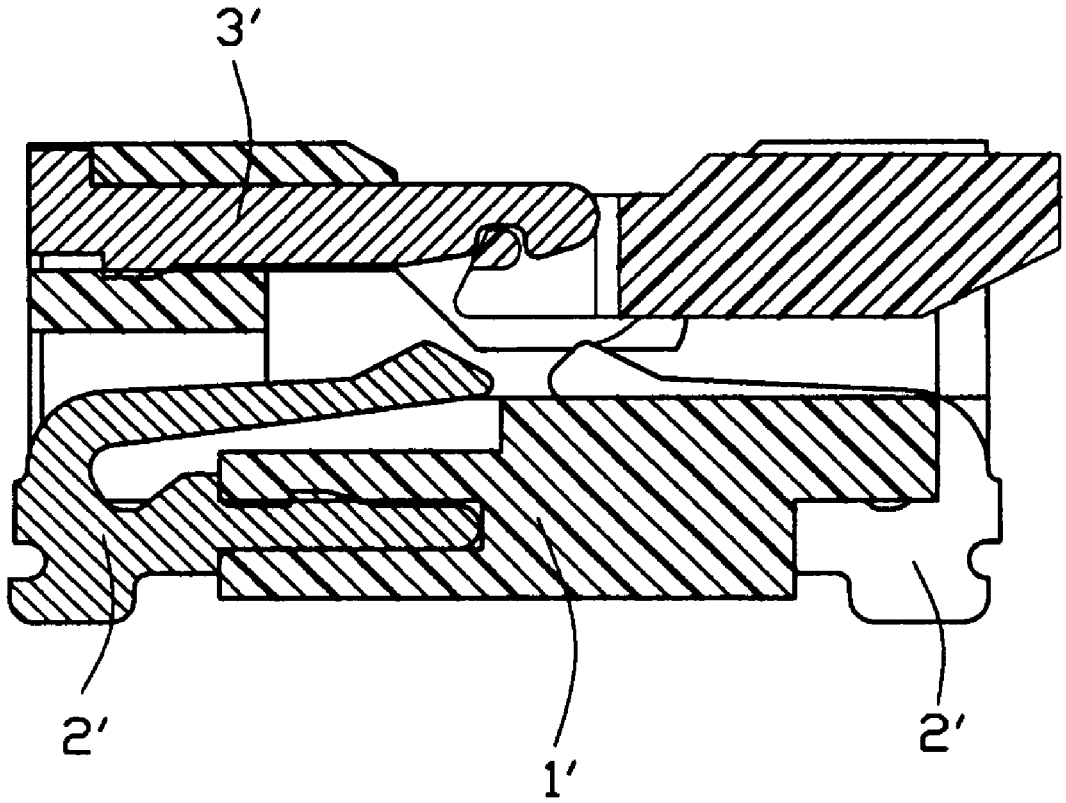
FIG. 9 is a cross-sectional view of FIG. 8 taken along line 9-9.
Figure 10:
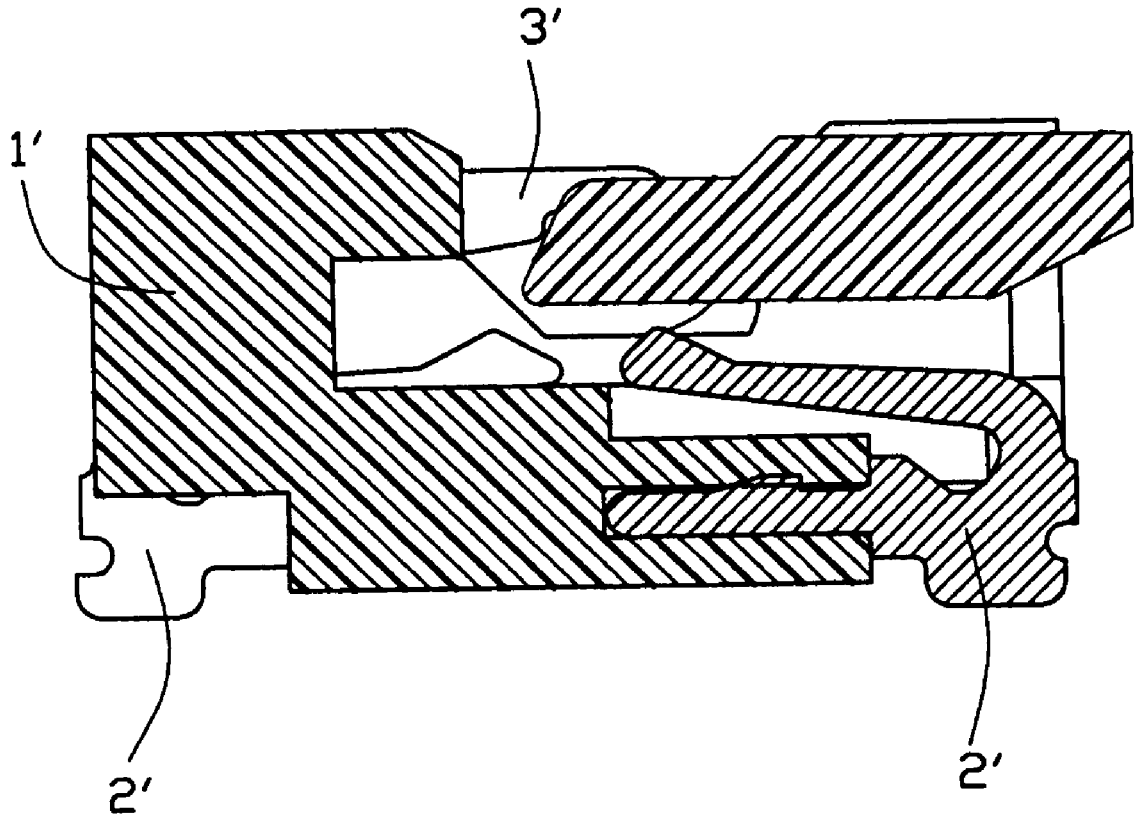
FIG. 10 is a cross-sectional view of FIG. 8 taken along line 10-10.

Turning to FIGS. 8-10, description will be made as an FPC connector according to the second embodiment of the present invention. Similar parts are designated by like reference numbers.

In the second embodiment, the terminals 2' are arranged in two rows in the insulative housing 1' wherein the terminals 2' in different row are alternatively arranged along the longitudinal direction of the insulative housing 1, and the pivot beams 3' are disposed at the upper side of the first row of terminals 2', as well as the first embodiment. The difference between the first and second embodiments is that the pivot beams 3' in the second embodiment are disposed in the positions corresponding to the terminals 2' in the first row as illustrated in FIGS. 8-10, rather than that the pivot beams 3 are disposed between some of two adjacent terminals 2 in the first row, as disclosed in the first embodiment. That is to say, each of the pivot beams 3' in the second embodiment is exactly positioned at the upside of one of the terminals 2' in the first row. As the shape and arrangement of other parts is substantially the same as that of the first embodiment, it would be not repeated here.

However, the disclosure is illustrative only, changes may be made in detail, especially in matter of shape, size, and arrangement of parts within the principles of the invention.

What is claimed is:

1. An electrical connector adapted to be detachably fitted with a sheet-like member, comprising:

a housing defining a longitudinal direction and a cavity having a front opening for receiving the sheet-like member;

terminals arranged in a row at a rear portion of the housing along the longitudinal direction and each having a contact portion protruding into the cavity;

pivot beams loaded in the housing, arranged in a row at an upper side of the row of the terminals and separately set from the terminals; and an actuator pivotally engaging with the pivot beams and rotating between an open position and a closed position; wherein each of the pivot beams is located between some of two adjacent terminals along the longitudinal direction.

2. The electrical connector as described in claim 1, wherein the separate set pivot beams and terminals have space therebetween filled with plastic of the housing.

3. The electrical connector as described in claim 1, wherein each of the terminals has a fixing arm fixed in the housing, a contact arm substantially parallel to the fixing arm, and a solder foot extending down from a joint of the fixing arm and the contact arm, and wherein the contact portion is formed at the contact arm.

4. The electrical connector as described in claim 1, wherein each of the pivot beams has a hook-like tail hooking at the housing.

5. The electrical connector as described in claim 1, wherein the housing is formed with a pair of lock blocks at the longitudinal end portions thereof and the actuator accordingly defines a pair of cutouts for engaging with the lock blocks so as to maintain the actuator in the closed position.

6. The electrical connector as described in claim 1, wherein each of the pivot beams is exactly positioned at the upside of one of the terminals.

7. The electrical connector as described in claim 1, further comprising a second row of terminals arranged at a front portion of the housing, wherein the row of terminals arranged in the rear portion of the housing is called as the first row of terminals.

8. The electrical connector as described in claim 7, wherein the first and second rows of terminals are arranged in a fashion that the terminals in the first row and the terminals in the second row both have the contact portions thereof towards each other.

9. The electrical connector as described in claim 7, wherein the terminals in the first row and the terminals in the second row are alternatively arranged along the longitudinal direction.

10. The electrical connector as described in claim 7, wherein the terminals in the first row and the terminals in the second row are of the same form.

11. An electrical connector for use with a flexible sheet-like member having circuit thereon, comprising:

an insulative housing defining a cavity for receiving said flexible sheet-like member;

a plurality of terminals disposed in the housing with contacting portions extending into the cavity for mechanical and electrical engagement with said flexible sheet-like member;

a plurality of reinforcement pieces being discrete form the terminals but associated with the housing, each of said reinforcement pieces defining a pivot portion;

an actuator pivotally engaged with the pivot portions and rotatable between opening and closed positions so as to result in an engagement between the terminals and the flexible sheet-like member; wherein the pivot portions of the reinforcement pieces downwardly vertically directly communicatively face the cavity.

12. The connector as claimed in claim 11, wherein each of said reinforcement pieces is not mechanically and electrically connected to any terminal.

13. The connector as claimed in claim 12, wherein each of said reinforcement pieces is metallic and is a single piece inserted into the housing.

14. The connector as claimed in claim 13, wherein each of the reinforcement pieces and the corresponding terminal are aligned with each other in a common vertical plane while being spaced from each other by the housing.

15. The connector as claimed in claim 11, wherein each of the pivot portions is opposite to the corresponding contacting portion in a vertical direction perpendicular to an insertion direction of the flexible sheet-like member.

* * * * *